US006195844B1

(12) United States Patent
Jourde et al.

(10) Patent No.: US 6,195,844 B1
(45) Date of Patent: Mar. 6, 2001

(54) METHOD AND DEVICES FOR PRODUCING A TEXTILE FLEECE

(75) Inventors: Bernard Jourde, Elbeuf; Jean-Christophe Laune, La Saussaye; Robert Jean, Fouqueville, all of (FR)

(73) Assignee: Asselin, Elbeof (FR)

( * ) Notice: Subject to any disclaimer, the term of this patent is extended or adjusted under 35 U.S.C. 154(b) by 0 days.

(21) Appl. No.: 08/986,109

(22) Filed: Dec. 5, 1997

(30) Foreign Application Priority Data

Nov. 7, 1997 (FR) ..... 97-14065

(51) Int. Cl.[7] ..... D04H 5/08
(52) U.S. Cl. ..... 19/163; 19/161.1; 19/296
(58) Field of Search ..... 19/65 A, 98, 99, 19/106 R, 161.1, 163, 302, 300, 296

(56) References Cited

U.S. PATENT DOCUMENTS

| | | | | |
|---|---|---|---|---|
| 314,369 | * | 3/1885 | Dolge | 19/161.1 |
| 3,877,628 | | 4/1975 | Asselin et al. . | |
| 4,107,822 | | 8/1978 | Brown . | |
| 4,271,565 | * | 6/1981 | Grunder | 19/106 R |
| 4,287,246 | * | 9/1981 | Thornton et al. | 428/113 |
| 4,944,502 | | 7/1990 | Platzer et al. . | |
| 4,984,772 | * | 1/1991 | Freund | 19/163 |
| 5,060,347 | | 10/1991 | Beckers . | |
| 5,325,571 | | 7/1994 | Bolliand . | |
| 5,341,543 | | 8/1994 | Jean et al. . | |
| 5,400,475 | * | 3/1995 | Hille | 19/163 |
| 5,655,262 | * | 8/1997 | Sterin et al. | 19/200 |

FOREIGN PATENT DOCUMENTS

| | | | |
|---|---|---|---|
| 0 528 348 A1 | | 12/1992 | (EP) . |
| 2195365 | * | 4/1988 | (GB) . |
| 06116853 | | 4/1994 | (JP) . |

* cited by examiner

*Primary Examiner*—Danny Worrell
*Assistant Examiner*—Gary L. Welch
(74) *Attorney, Agent, or Firm*—Greer, Burns & Crain, Ltd.

(57) ABSTRACT

A carding machine or other web production device [(1)] supplies a crosslapper [(2)] with two elementary webs [(15*a*, 15*b*)] constituting a lappable web [(16)] which is deposited in a reciprocating manner on a transverse output belt [(26)].

In the device [(1) means of] adjustment of the speed of rotation of doffers [(13*a*, 13*b*)], of condensers [(17, 18)], of detachers [(19*a*, 19*b*)], of the drum [(4)] and/or of the feeder [(7)], and/or [means of] adjustment of the drum-doffer spacing affect the weight per unit area of the elementary web produced taking account of the weight per unit area desired at each point in the width of the fleece [(67)] to be formed on the output belt [(26)]. There is determined the delay length exhibited by each elementary web cross-section undergoing the adjustment of weight with respect to the section of lappable web in the process of being deposited. From this there is derived the position at which each web cross-section will be deposited when it is undergoing the adjustment of thickness and consequently the weight adjustment to be applied to it.

[Utilization] The present invention is useful for producing fleeces of highly varied profiles with great industrial flexibility.

85 Claims, 3 Drawing Sheets

METHOD AND DEVICES FOR PRODUCING A TEXTILE FLEECE

The present invention relates to a method of producing a textile fleece by means of a crosslapper.

The present invention also relates to various devices making it possible to use this method.

It is known to produce a lappable web in a carding machine or in another device such as, for example, a pneumatic fleecing machine. The lappable web thus obtained feeds a crosslapper in which the web is folded alternately in one direction and then in the other on an output belt. The fleece is thus composed of web segments, alternately inclined in one direction and in the other, which overlap. The folds between successive segments are aligned along the lateral edges of the fleece produced.

The fleece of fibres produced is generally intended for a subsequent process of consolidation, for example by needling, coating, and/or etc . . .

FR-A-2 234 395 reveals the speed relationships with which it is necessary to comply in the crosslapper in order to control the thickness of the fleece at all points in its width.

According to EP-A-0 315 930, the fleece can have, in cross-section, a non-uniform thickness profile. To achieve this, the speed of the lapper carriage which deposits the lappable web at a variable point in the width of the output belt is varied with respect to the speed of the belts which feed the web onto the output belt through this carriage. If, in a given position in the width of the fleece, the carriage moves at a speed greater than that at which it feeds the web, the web is stretched and this reduces the thickness of the fleece at this location. If, on the contrary, the speed of the carriage is less than the feed speed, the web is deposited in a compressed form which increases the thickness of the fleece at this location.

This method of profiling the fleece has certain limitations. With certain types of fibres or certain types of webs, in particular those in which the fibres are strictly longitudinal, the traction or compression stresses imposed on the web tend to be absorbed by elasticity after the depositing of the lappable web on the output belt, and/or to be transmitted to adjacent regions of the web. Furthermore, the traction or compression imposed on the web cannot, without risks, exceed certain limits which vary according to the nature of the web and of the fibres.

EP-B-0 371 948 describes a method intended to pre-compensate for the faults arising during the subsequent consolidation, in particular during the needling, by locally varying the thickness of the lappable web fed into the crosslapper. This is obtained by automatically regulating the speed of a doffer of the carding machine with respect to the speed of the carding machine drum. The faster the doffer rotates with respect to the drum, the lower the weight per unit area becomes. The purpose of the present invention is to improve this known method with regard to at least one of the following aspects:

- inertias involved in order to vary the weight per unit area of the web entering the cross-lapper;
- accuracy in so determining an elementary web cross-section in which a predetermined weight per unit area must be produced, that this cross-section will occupy a predetermined position in the width of the fleece produced by the crosslapper;
- compatibility between the variable speeds of the doffer and the speeds, also variable, of the lapper carriage of the crosslapper;
- broadening of the possible applications of the method;
- definition of new structures for the lappable web.

According to the first aspect of the invention, the method of producing a textile fleece in which there is produced at least one elementary web and then, by means of a crosslapper, a lappable web incorporating said elementary web is folded, alternately in one direction and in the other, on a transverse output belt of the crosslapper, is characterised in that by substantially modifying at least one adjustment upstream of the crosslapper according to a periodic law, the lappable web fed into the crosslapper is given a weight per unit area which varies along the longitudinal direction of the lappable web in such a way that the fleece obtained at the output of the crosslapper has over its width a substantially predetermined distribution of weight per unit area.

It can be advantageous that the adjustment which is modified upstream of the crosslapper comprises an adjustment affecting the carding machine in a zone located downstream of a drum of the carding machine, with respect to the direction of transit of the fibres in the carding machine, and independently of the speed of rotation of a doffer taking from the carding drum the fibres intended to constitute the elementary web.

The rotational movement of the doffer involves high inertias and this limits the reaction speed when modifying the adjustment of the speed of rotation.

By making the adjustment other than by variation of the speed of rotation of the doffer, it is possible to make faster and therefore better located variations. In particular, it is possible to vary the spacing between the periphery of the drum and the periphery of the doffer. The greater this spacing becomes, the thinner the layer of fibres taken by the doffer from the drum becomes. There is also the advantage that this adjustment method does not modify the production speed of the web and therefore does not raise any particular problem at the input of the crosslapper.

The invention also contemplates varying the speed of devices placed upstream of the doffer. For example, it is possible to vary the speed of the devices called "feeder" devices of the carding machine which feed, at least indirectly, the carding machine drum with fibres upstream of the said drum. It is also possible to vary the speed of the carding machine drum with respect to the doffer. All of these solutions also have the advantage of not affecting the production speed of the web which can therefore remain at each instant equal to a constant speed of input into the crosslapper. In order to reduce the inertia of the drum, the latter can be made from carbon.

When the doffer is followed by at least one condenser cylinder, it is possible to vary the speed of at least one condenser cylinder with respect to the doffer in such as way as to more or less condense the elementary web taken from the drum by the doffer.

The last element at the output of the carding machine generally consists of a device called a detacher which detaches the web from the last condenser cylinder, or from the doffer in the absence of a condenser cylinder. It is also proposed, according to the invention, to regulate the weight per unit area of the web by varying the action of the detacher. In particular, when this detacher is a rotating cylinder provided with a peripheral lining, it is possible to vary the speed of rotation of the detacher with respect to the rotary device, for example a doffer or a condenser, located immediately upstream.

According to an important aspect of the invention, when the adjustment made has the effect of varying the speed at which the web produced is supplied to the crosslapper, which is particularly the case when the procedure is to vary the speed of a doffer, a condenser cylinder or a detacher, the speed of input into the crosslapper is caused to vary in such a way that it substantially corresponds, at each instant, to the speed at which the web arrives at the crosslapper, and at each instant the length of a web accumulation path in the crosslapper is adjusted in order to compensate for the differences between the instantaneous speed of input into the crosslapper and the instantaneous speed at which the crosslapper feeds the lappable web onto the output belt.

The known crosslappers define a web accumulation path. FR-A-2 234 395 reveals a variation in the length of this path so that the speed at which the lapper carriage feeds the web onto the output belt varies and in particular is cancelled out when the speed of the lapper carriage is itself zero at its motion reversal points. According to the present aspect of the invention, the length of web accumulated in the crosslapper is also varied, but in order to compensate for the fluctuation in the speed at which the lappable web enters the crosslapper because of the adjustment of the weight per unit area carried out upstream. It also falls within the scope of this aspect of the invention to vary the length of web accumulated in the crosslapper in order to take account of the variations in the speed of input of the web into the crosslapper and at the same time of the variations of the speed at which the lapper carriage feeds the web onto the output belt.

It is for example possible to directly control the speed of an entering section of a conveyor belt of the crosslapper in order to have this speed comply with that at which the carding machine or other production apparatus supplies the web. The speed of an accumulator carriage of the crosslapper over which this conveyor belt passes is then controlled in such a way that this same belt assumes in the lapper carriage, over which it also passes, and taking account of the speed of displacement of the lapper carriage, a web feed speed corresponding to the desired speed.

Conversely, it is also possible to directly control the speed of a section of the conveyor belt adjacent to the lapper carriage so that the lapper carriage's feed speed corresponds with the desired speed. The speed of the accumulator carriage is then controlled in such a way that the entering section of the conveyor belt has a speed which complies with that at which the carding machine produces the web.

The term "web cross-section" will refer to a cross-section of the web at a predetermined point in the length of the web.

The term "delay length" will refer to the length of web contained between, on the one hand, a first web cross-section in the process of being deposited on the fleece which is being formed in the crosslapper and, on the other hand, a second web cross-section which is located in the fibres path at the point where the said adjustment has an effect on the weight per unit area of the elementary web upstream of the crosslapper.

According to another important aspect of the invention, the delay length is determined and, in accordance with the latter, the point in the width of the fleece where the second cross-section will be deposited is determined. The weight per unit area of the second cross-section is then adjusted according to the weight per unit area programmed for the said point in the width of the fleece. If the crosslapper, by construction or by programming, feeds the lappable web onto the output belt at a speed which is always equal to the speed of displacement of the lapper carriage, and if there is no stretching of the web upstream of the lapper carriage, the lappable web to be produced is the same as the one which would be obtained by unfolding the fleece obtained in order to re-obtain the web.

If a stretching with a constant factor greater than one (actual stretching) or less than one (compression) occurs in the path of the web between the two cross-sections, it is a corrected delay length which will have to be taken into account for the section located upstream of the zone where the stretching occurs. If for example a stretching factor equal to 1.1 occurs at a point in the path, the section of the delay length located upstream of this point must be multiplied by 1.1 (increased by 10%) in order to know the corrected delay length to be taken into account. The web to be produced is then different from the one which would be obtained by unfolding the fleece obtained.

Variable stretching can also take place in the path of the web up to its deposit on the output belt and, in particular, between the lapper carriage and the output belt. In a known way, this typically results in a variable difference between the speed of displacement of the lapper carriage and the speed at which the lapper carriage feeds the lappable web onto the output belt. It is then possible, in the central processing unit, to provide integral calculation software making it possible to obtain a corrected delay length by summing the elementary displacements of the lapper carriage necessary for depositing the elementary lengths of the actual delay length on the output belt, as a function of the stretching value provided for at each point in the reciprocating travel of the lapper carriage. This calculation can also be performed outside of the machine and a table of corrected delay lengths for each position of the lapper carriage can be entered into the memory of the machine. During operation, a central processing unit of the production device can then, very rapidly, for each position of the lapper carriage, by referring to the table, know the position which will be taken in the width of the fleece by the web cross-section which is at that moment being subjected to the adjustment of weight per unit area. It is also possible, after a programming stage before starting the production of the fleece, to provide for the central processing unit to calculate the said table, and to put it into memory in order to be able, during the production, to refer to it for each position of the lapper carriage. Yet another method will be revealed within the description.

The method according to the invention can be implemented by means of a programmable control allowing the user to enter into memory the distribution of weights per unit area desired for the lappable web arriving in a lapper carriage of the crosslapper at each point in a travel of the lapper carriage. The programming can affect a single travel consisting of a forward or a return motion between the two travel reversal points, or a forward and return motion to allow the user to adjust differently the weight per unit area of the web in the forward and in the return motion of the lapper carriage at at least one predetermined point in the width of the fleece. In a simple version where the weight per unit area is adjusted only for a single travel and where no stretching is provided at the output of the lapper carriage (and therefore no difference between the speed of displacement of the lapper carriage and the speed at which the lapper carriage feeds the web onto the output belt), it is equivalent to program the weight per unit area desired for the web at each point in the single travel of the lapper carriage and to program the weight per unit area desired for the fleece at each point of its width.

In more sophisticated versions, it is however possible to combine, as stated above, a variation of the weight per unit area of the web arriving in the lapper carriage and a variation of the stretching produced by a difference between the speed of displacement of the lapper carriage and the web feed speed through the lapper carriage. In this case, it is advantageous for the two parameters to be able to be programmed separately for each point in the travel (single or forward and return) of the lapper carriage. The data of this program will be used by the programmable control to determine, as stated above, the point in the width of the fleece where a cross-section in the process of undergoing adjustment of weight per unit area will be deposited, and consequently the weight per unit area to be obtained at that instant by means of the said adjustment.

In certain crosslappers of simple construction, the variable stretchings at the output of the lapper carriage are an inevitable disadvantage consisting in compressions at the ends of travel of the lapper carriage. The adjustment of weight per unit area of the lappable web according to the invention makes it possible to compensate for this defect. In order to do this, the lappable web cross-sections intended to form the edges of the fleece have a reduced weight per unit area.

It is possible to produce the lappable web by superimposing at least two elementary webs. Many carding machines in fact have at least two doffers each producing an elementary web in order to increase the production possible from a single carding drum. It is therefore possible to structure the lappable web by giving different structures to the two elementary webs. For example, one of the feed webs can be condensed in order to give the fibres a sinuous orientation on either side of the longitudinal direction, the other being less condensed or not condensed at all in order that a certain quantity of longitudinal fibres provides the lappable web with dimension stability in the direction of the length, in particular with respect to traction forces.

It can therefore be advantageous to enhance the structuring effect by differently adjusting the respective weights per unit area of the two elementary webs in order to result in the desired lappable web.

On the one hand, the delay lengths can be different for the two elementary webs. It is therefore necessary to provide a corresponding phase shift between the two adjustments carried out at each instant.

On the other hand, it may be desired that the elementary web cross-sections which are superimposed should have weights per unit area which are similarly affected by the adjustment or, on the contrary, differently affected. For example, it is possible to arrange that only one of the two elementary webs undergoes a variation of weight per surface area.

If the variations in weight per surface area are obtained in a way inducing a variation in the speed of production of the web, it is preferable that the delay lengths are substantially the same for all of the elementary webs and that the speed variations undergone by the elementary webs are substantially the same, in order that the elementary webs have substantially the same speed at the elementary webs superimposition station. Depending on the geometry of the carding machine, it is possible, in certain cases, to equalize the delay lengths by using different adjustment means, for example by adjusting the weight per unit area of one elementary web by means of the doffer and the weight per unit area of the other elementary web by means of the condenser.

It is possible to arrange that one of the elementary webs undergoes the relatively slow variations in weight per unit area, operated by means of a variation in the speed of rotation of the drum with respect to the speed of rotation of the doffer, and that the other elementary web undergoes the more sudden variations, intended for example for producing a change in thickness between two zones of the final consolidated product, for example by means of a variation in the separation between the doffer and the drum of the carding machine.

It should however be noted that such different processing of the slow and sudden variations in weight per unit area is also possible on one and the same elementary web, particularly, but in no way limitatively, when the lappable web is obtained from a single elementary web. It is then possible, for example, to operate the slow variations by variation in the speed of the doffer or of the drum and the sudden variations by another means, for example by varying the speed of rotation of one or of several condenser cylinders with respect to the doffer or of a detacher cylinder with respect to the rotary device, the doffer or the condenser, located immediately upstream.

The invention also encompasses producing a lappable web by means of two elementary webs each of which has its weight per unit area adjusted solely by variation of the speed of rotation of the doffer with respect to the drum, or for just one of the elementary webs to have its weight per unit area adjusted by variation of the speed of rotation of the doffer with respect to the drum.

The fact that the speed of rotation of the doffer is used as a variable for the adjustment of the weight per unit area of the associated elementary web does not mean that the other speeds of rotation remain constant over the path of this elementary web: when the speed of a rotary device located downstream of the drum is modified in order to vary the weight per unit area of the web produced, the drive speed of all of the drive elements located further downstream must be modified substantially in proportion if it is desired to transmit the longitudinal profile of the weights per unit area generated by the adjustment without modification. When the speed of transfer of fibres from a device located upstream of the doffer is adjusted, it may be appropriate to modify, in a complying manner, the speed of transfer of the fibres of devices located further upstream.

According to another aspect of the invention, the device for the implementation of a method according to the first aspect, comprising a carding machine integrating at least one means of adjustment during operation under the action, at least indirect, of a programmable control, of the thickness of at least one elementary web produced in a web production path, is characterized in that this adjustment means is chosen from among:

- a means of adjusting a separation between a doffer and a drum of the carding machine,
- a means of adjustment of the speed of rotation of a condenser with respect to the speed of rotation of the doffer of the carding machine,
- a means of adjustment of the speed of rotation of a detacher with respect to the speed of rotation of a fibre transfer device, such as a doffer or a condenser, located immediately upstream;
- a means of adjustment of the speed of a fibre transfer device located upstream of the doffer.

According to another version of the device for the implementation of the method according to the first aspect, the latter comprises a web production device having at least two production paths for respective elementary webs, the two paths then joining each other at a station for superimposing the two webs, and is characterized in that it furthermore comprises at least one means of adjustment, during operation, under the action of a programmable control, of the thickness of at least one of the elementary webs, in order that the lappable web obtained by superimposition of the elementary webs has a thickness which varies along its longitudinal direction.

According to another aspect of the invention, the device for implementing the method, comprising a device for producing at least one elementary web, and including a means of adjustment of the weight per unit area of at least one elementary web produced, a crosslapper receiving a lappable web incorporating the said at least one elementary web and driving the lappable web, along a variable geometry path, into a lapper carriage having a transverse reciprocating motion above an output belt, and a programmable control capable of sending, at least indirectly, to said adjustment means a control signal for the weight per unit area to be given to the elementary web at each instant as a function of the position of the lapper carriage, is characterized in that the programmable control comprises means for taking into account the length of web between a first web cross-section in the process of being deposited on the output belt of the crosslapper and a second web cross-section undergoing the adjustment, and a total distance which the lapper carriage will have to travel in order to deposit this length, in order to determine the point in the width of the fleece where the second web cross-section will be deposited, and in order to form the said control signal as a function of the weight per unit area desired for the lappable web at the point in the width of the fleece where this second web cross-section will be deposited.

According to yet another aspect of the invention, the device for implementing the method, comprising:

a crosslapper including a lapper carriage with a transverse reciprocating motion above an output belt, and an accumulation means for adjusting the length of a lappable web accumulated in the crosslapper; and a device for producing at least one elementary web for composing the lappable web sent to the input station in the crosslapper, is characterized in that the production device includes, in order to adjust the weight per unit area of the elementary web, an adjustment means producing a fluctuation of the speed of the lappable web about the average speed at which the lapper carriage feeds the lappable web, and in that the accumulation means is controlled in order to vary the length of web accumulated in the crosslapper as a function of the difference between the input speed of the lappable web into the crosslapper and the speed at which the lapper carriage feeds the web onto the output belt.

Other features and advantages of the invention will furthermore emerge from the following description relating to non-limitative examples.

At this point it is stated that the figures are purely illustrative and do not claim to show either the production details nor the actual proportions of a carding machine and of a crosslapper.

Figure 1:
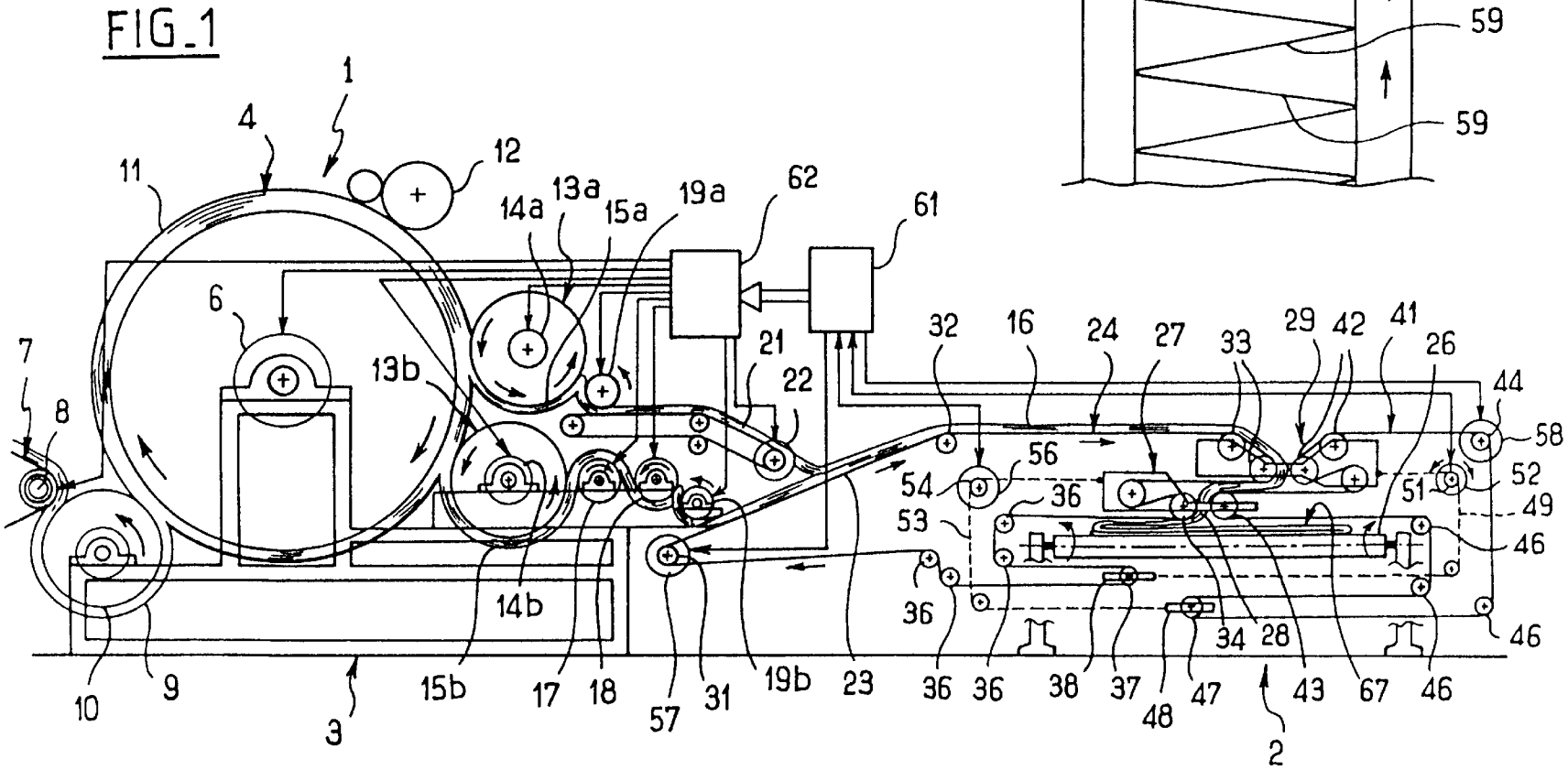
FIG. 1 is a diagrammatic side elevation view of a device according to the invention.

In the example shown in FIG. 1, the device comprises a carding machine 1 and a crosslapper 2.

The carding machine 1 comprises a frame 3 supporting in rotation a carding drum 4 driven in rotation by a motor 6. The frame 3 also supports at least one "feeder" 7 essentially comprising a conveyor belt driven in rotation by a motor 8. The feeder 7 carries textile fibres 9 coming from a reserve and deposits them, in general by the intermediary of at least one cylinder 10, on the periphery of the drum 4. Thus, the feeder 7 regularly renews a layer of fibres 11 on the periphery of the drum 4. Around the periphery of the drum 4, there are cylinders of known type, such as 12, (only one pair of which is shown in the interests of clarity) which serve to work the fibres and in particular to orientate them circumferentially on the periphery of the drum 4.

The fibres coming from the feeder 7 arrive at the drum 4 at the start of the rising zone of the periphery of the drum 4.

In the descending zone of the periphery of the drum 4 there is at least one doffer 13*a*, 13*b* consisting of a cylinder rotating about its axis parallel to that of the drum 4 by means of a specific motor 14*a*, 14*b*. Between each doffer 13*a*, 13*b* and the periphery of the drum 4 there is a spacing chosen such that each doffer 13*a*, 13*b*, due to an appropriate lining of its cylindrical periphery, takes up a portion of the fibres 11 driven in rotation by the drum 4 in order to form with these fibres an elementary web 15*a*, 15*b*. In the example shown, the elementary web 15*a*, after having made a fraction of a turn at the periphery of the doffer 13*a*, is taken by a detacher cylinder 19*a* in order for it to be deposited on an intermediate conveyor 21 driven in rotation by a specific motor 22.

The elementary web 15*b*, after having made a fraction of a turn on the periphery of the doffer 13*b*, is taken by a succession of two condenser cylinders 17, 18 and then, from there, by a detacher cylinder 19*b*.

The condenser cylinders 17, 18 and the two detacher cylinders 19*a*, 19*b* have axes parallel with the doffers 13*a*, 13*b* and have external diameters which are much smaller than those of the cylinders of the doffers. In general, the detacher cylinders 19*a*, 19*b* are themselves of smaller diameter than the condenser cylinders 17, 18. The first condenser cylinder 17 is substantially tangential to the periphery of the doffer cylinder 13*b*, with however a spacing between them. The same applies to the second condenser cylinder 18 with respect to the first condenser cylinder 17 and to the detacher cylinder 19*a* with respect to the doffer cylinder 13*a* and to the detacher cylinder 19*b* with respect to the second condenser cylinder 18.

The condenser cylinder 17 has a peripheral speed which is lower than that of the doffer 13*b* located just upstream in order to generate an increase in the weight per unit area of the web, accompanied by the imparting of a sinuous orientation to the fibres in the web. In general, the condenser cylinder 18 rotates at a speed lower than that of the condenser cylinder 17.

FIG. 1 uses arrows to illustrate that, in a conventional manner, everywhere where cylinders are substantially tangential by their peripheries, the speeds at the periphery are orientated in the same direction, except with regard to the detachers 19*a*, 19*b* which therefore cause the direction of displacement of the fibres to be reversed in the vicinity of the point of tangency with the preceding rotary element 13*a* and 18 respectively.

The detacher 19*b* deposits the second elementary web 15*b* directly onto a front conveyor belt 24 of the crosslapper 2 and more particularly on a section 23 by which this belt enters the crosslapper 2. The intermediate conveyor 21 deposits the first elementary web 15*a* on the section 23 above the elementary web 15*b* deposited upstream in such a way as to compose a lappable web 16 with the superimposition of the elementary webs 15*a* and 15*b*.

The function of the crosslapper 2 is to deposit the web 16 in a zig-zag on an output belt 26 moving perpendicularly to the direction of input of the lappable web 16 into the crosslapper. The direction of displacement of the output belt 26 is therefore approximately perpendicular to the plane of FIG. 1. In order to thus deposit the web, the crosslapper comprises a lapper carriage 27 which moves with a reciprocating motion over the output belt 26, parallel with the width of the latter. The lapper carriage 27 has, above the output belt 26, a slot 28 through which the lappable web 16 is fed at a variable point in the width of the output belt 26.

The crosslapper furthermore comprises an accumulator carriage 29 moving with a reciprocating motion over the lapper carriage 27 and parallel with the latter.

After the input section 23 defined by fixed rotary rollers 31, 32, the front belt 24 turns through 180° over two rollers 33 carried by the accumulator carriage 29 and then defines one of the sides of the feed slot 28 on turning round a roller 34 carried by the lapper carriage 27. The front belt 24 then follows a return path over various fixed rollers 36, passing though a 180° loop over a roller 37 carried by a compensating carriage 38 which moves at each instant at a speed equal and in opposite direction to that of the accumulator carriage 29. The length of the path followed by the belt 24 is always the same because any variation in the length of the loop formed by the belt 24 on the accumulator carriage 29 is compensated for by a contrary variation in the length of the loop formed by the belt 24 on the compensating carriage 38.

The lappable web 16 moves substantially along the external surface of the front belt 24 from the input section 23 up to the feed slot 28. The lappable web 16 therefore forms an accumulation loop of variable length around the rollers 33 of the accumulator carriage 29 as a function of the position of the carriage along its reciprocating travel. In certain known crosslappers, the accumulator carriage 29 is displaced in such a way as to vary the length of the accumulation loop in order to accumulate web when the constant input speed is greater than the instantaneous speed at which the lapper carriage feeds the web onto the output belt, and in order to return a portion of this loop towards the lapper carriage in the opposite case. Less sophisticated crosslappers are also known in which the lapper carriage feeds the web with a constant speed equal to the constant input speed: the accumulator carriage then serves only to conserve a constant length of web in the crosslapper whatever the position of the lapper carriage along its reciprocating travel may be.

In the section of its path contained between the accumulator carriage 29 and the lapper carriage 27, the lappable web 16 is supported, on the side opposite the front belt 24, by a rear belt 41. The latter passes over rollers 42 carried by the accumulator carriage 29 and goes around, on the lapper carriage 27, a roller 43 on which the rear belt defines the other side of the feed slot 28, opposite the roller 34. The rest of the path of the rear belt 41 is defined by fixed-position rotary rollers 44, 46, while also passing though a 180° loop over a roller 47 carried by a compensation carriage 48 which moves at each instant at a speed equal and opposite in direction to that of the lapper carriage 27. In this way, the path followed by the rear belt 41 has a constant length as any variation in the length of the 180° loop formed by the rear belt 41 around the roller 43 of the lapper carriage 27 is compensated for by a contrary variation in the length of the 180° loop formed by the same belt on the compensating carriage 48.

The accumulator carriage 29 is connected to the associated compensating carriage 38 by means of an inextensible cable 49 making an overall turn of 180° between its end coupled with the accumulator carriage 29 and its other end coupled to the associated compensating carriage 38. This 180° turn is made at least partly over a drive pulley 51 coupled to a drive motor 52 having two directions of rotation which is of the servo-motor, stepper-motor or similar type. In each direction of rotation, the cable 49 pulls the accumulator carriage 29 or the compensating carriage 38 respectively in the direction lengthening the loop formed on it by the front belt 24. Taking account of the invariable length of the front belt 24, the other loop must necessarily shorten and move the other carriage in the desired direction. If necessary, in a known way, in order to avoid the tension resulting in the front belt 24 and the corresponding wear of the belt, a second cable can connect the accumulator carriage 29 and its compensating carriage 38 passing on the other side of the output belt, as described in EP-B-522 893.

The control of the lapper carriage 27 and of the associated compensating carriage 48 is achieved substantially in the way described for the accumulator carriage 29 and the associated compensating carriage 38. A cable 53 connects the two carriages 27, 48 making a 180° loop at least partly over a pulley 54 mounted in a fixed position and connected to a servo-motor, stepper motor or similar with two directions of rotation 56. In each of the directions of rotation, the motor 56 pulls the carriage 27 or 48 in the sense of lengthening the loop made on the carriage by the rear belt 41. The other carriage then moves in the opposite direction due to the invariability of the length of the rear belt 41 or due to an additional cable passing on the other side of the output belt 26.

Furthermore, the speed of circulation of the front belt 24 is defined by a servo-motor, stepper motor or similar 57 associated with one 31 of the fixed cylinders supporting the front belt 24 in the input section 23. The speed of circulation of the rear belt 41 is defined by a servo-motor, stepper motor or similar 58 associated with the fixed cylinder 44 supporting the rear belt along its return section contained between the compensating carriage 48 and the accumulator carriage 29.

Figure 2:
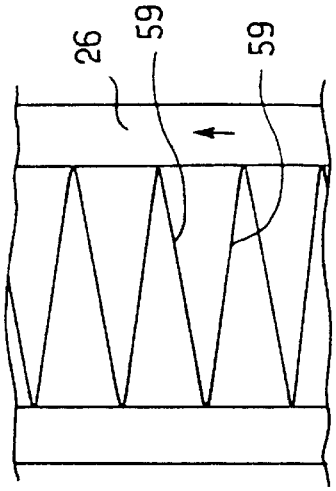
FIG. 2 is a top view of the fleece produced on the output belt.

During operation, the lappable web 16 is routed by the input section 23 of the front belt 24, then traverses the accumulator carriage 29 and then the lapper carriage 27 and forms, on the output belt 26, segments which overlap with a obliqueness which is alternately in one direction and then in the other. The rear edges of these segments, with respect to the direction of displacement of the output belt 26, can be seen at 59 in FIG. 2.

The crosslapper furthermore comprises a control unit 61 which at each instant manages the respective angular positions to be taken by the motors 52 and 56 controlling the position of the accumulator 29 and lapper 27 carriages along their reciprocating travels, and by the two motors 57 and 58 defining the circulation of the front 24 and rear 41 belts. In a way which is not shown, the control unit 61 can also control a motor driving the output belt 26 according to a known method, for example at a constant speed or, on the contrary, a speed proportional to that of the lapper carriage 27 as revealed in FR-A-2 234 395.

The device furthermore comprises a control unit 62 associated with the carding machine and controlling in a coordinated manner the speed of rotation of the illustrated, already described motors 6, 8, 14*a*, 14*b* and 22 as well as various other motors, not shown for reasons of clarity, driving, in particular, the detacher cylinder 19*a*, the condenser cylinders 17 and 18 and the detacher cylinder 19*b* respectively. All of these motors of the carding machine are capable, if necessary with the help of a regulating loop passing through the control unit 62, of executing a speed of rotation instruction and even, preferably, an angular position instruction determined at each instant, from which a speed of rotation determined at each instant also results.

One of the control units, preferably the control unit 61 associated with the crosslapper 2, is programmable in a way allowing the operator to define, for each position of the lapper carriage 27 along its reciprocating travel, the desired weight per unit area for the lappable web 16 in the cross-section undergoing depositing by the lapper carriage 27 on the output belt. Thus, each time that the lapper carriage passes through a predetermined point in its reciprocating travel, the lappable web 16 will have a predetermined weight per unit area and consequently the fleece produced, constituted at all points by a constant number of segments of superimposed web, shall itself have, at each point in its width, a respectively predetermined weight per unit area. This programming is feasible before starting a production, perfected embodiments making it possible to modify the programming during operation.

The variations in weight per unit area of successive cross-sections of web which are fed by the lapper carrier 27 onto the output belt 26 result from a control and continuous adjustment by the central processing unit 62 of the carding machine 1. In the example shown in FIG. 1, this adjustment can affect the speed of rotation of the motor 8 of the feeder 7 with respect to the speed of rotation of the motor 6 driving the drum 4. If the motor 8 rotates faster, the feeder 7 supplies more fibres at the periphery of the drum 4. Consequently, after a predetermined peripheral travel corresponding to a fraction of a turn of this cylinder 10 and a fraction of a turn of the drum 4, more fibres 11 arrive at the doffers 13*a* and 13*b*. This results in the production of elementary webs 15*a* and 15*a* having higher weights per unit area. Conversely, a slower rotation of the motor 8 of the feeder 7 produces elementary webs having lower weights per unit area.

The adjustment of weight per unit area can also consist, at least partly, in a variation of the speed of the carding drum 4. The faster the carding cylinder rotates with respect to the doffers 13*a* and 13*b*, the heavier per unit area are the elementary webs 15*a* and 15*b* collected by the latter. A variation of the speed of rotation of the drum 4 can, if necessary, be accompanied by a corresponding variation of the speed of rotation of the motors driving the fibre transfer devices located upstream, namely the feeder 7 and the cylinder 10 in the example shown.

The adjustment can also affect one or other of the doffers 13*a* and 13*b*. If their motors drive them at a faster speed with respect to that of the carding drum 4, they produce, at a faster speed, elementary webs 15*a* and 15*b* having lower weights per unit area. On the contrary, if the speed of rotation of at least one of the doffers 13*a* or 13*b* is slowed down, this produces, at lower speed, a web having a higher weight per unit area. Any variation in the speed of rotation of a doffer for the purpose of modifying the weight per unit area of the elementary web must be accompanied by a corresponding variation, that is to say in principle in the same proportion, in the speed of the web transfer devices located downstream, and therefore of the detacher 19*a* and the intermediate belt 21, as far as the doffer 13*a* is concerned, and the condensers 17 and 18 and the detacher 19*b*, as far as the doffer 13*b* is concerned, in the example shown. It is also appropriate to modify the speed of the input section 23 of the front belt 24 by an appropriate control of the motor 57 driving this belt, as will be explained in detail below.

It is generally ensured that the speeds of the two elementary webs 15*a* and 15*b* on arriving at the input section 23 of the front belt 24 are little different from one another and from the speed of circulation on this section, knowing that in practice differences in speed of the order of 10 to 15% are tolerable.

The adjustment of the weight per unit area of at least one elementary web 15*a* or 15*b* can also consist in an adjustment of the speed of rotation of the condensers 17 and 18 with respect to the speed of the doffer 13*b* located upstream, in order to more or less condense the elementary web produced by the doffer 13*b*. The condensation becomes greater, and consequently the weight per unit area becomes higher, as the speed of the condensers becomes slower with respect to that of the doffer 13*b*. It is possible to modify the speed of the first condenser 17 with respect to the speed of the doffer 13*b* and to proportionally vary the speed of the second condenser 18. It is possible to vary the speed of rotation of the condenser 18 with respect to that of the condenser 17, whether this latter speed be in a constant or variable ratio with that of the doffer 13*b*. In all cases, the transfer speeds defined by the detacher 19*b* and the input section 23 of the crosslapper vary in proportion to that of the condenser 18, if it is desired that these elements located downstream of the condenser 18 transmit, without modification, the variations in the weight per unit area of the elementary web 15*b*.

It is furthermore possible to modify the weight per unit area of a web 15*a* and/or 15*b* by varying the speed of rotation of the detacher 19*a* and/or 19*b* with respect to the speed of rotation of the fibre transfer device located immediately upstream, that is to say the doffer 13*a* with regard to the detacher 19*a,* and the condenser 18 with regard to the detacher 19*b*.

If the speed of rotation of the detacher 19*a* is varied with respect to that of the doffer 13*a,* the speed of the intermediate belt 21 is varied in a corresponding manner. Furthermore, here again, the speed of the input section 23 of the belt 24 is adapted to the variations which the adjustment of weight per unit area induces on the speed of production of the webs 15*a* and 15*b*.

Figure 3:
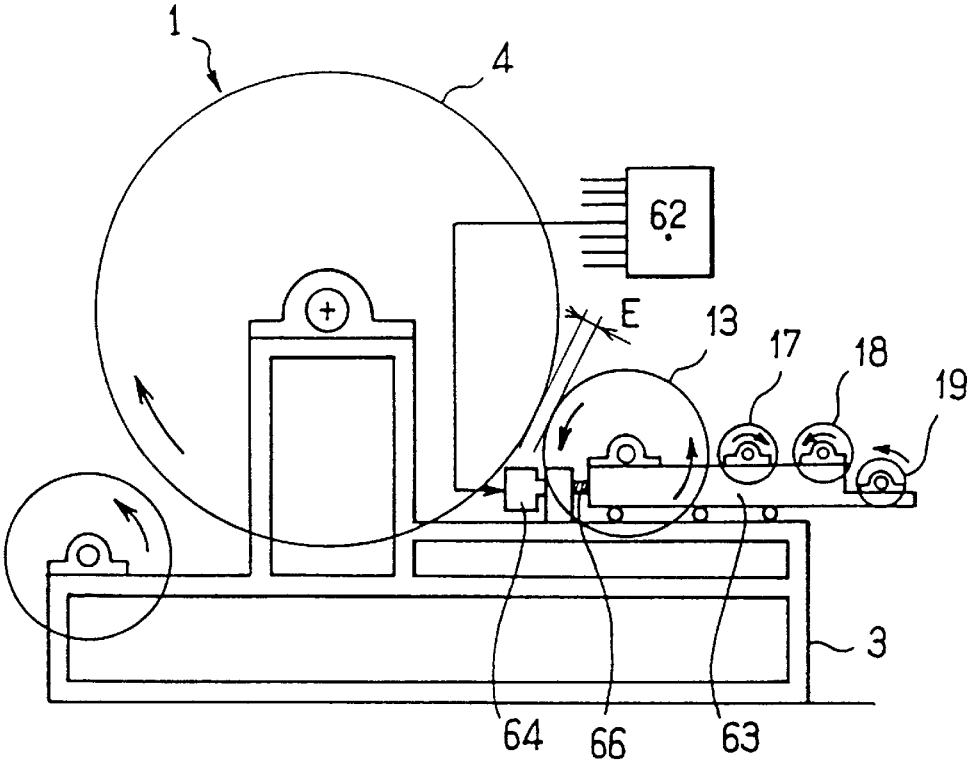
FIG. 3 is a view similar to a part of FIG. 1 but relating to another embodiment.

FIG. 3 shows another embodiment of the carding machine 1, according to which at least one doffer 13, and the condenser 17, 18 and the associated detacher 19 are all supported on a carriage 63 which is mobile with respect to the frame 3 of the carding machine 1 in a direction of translation causing a variation in the spacing E between the carding drum 4 and the doffer 13. The displacement of the carriage 63 is controlled by a positioning motor 64 receiving control signals coming from the control unit 62. The motor 64 actuates the carriage 63 for example by means of a screw mechanism 66. When, by an appropriate control of the motor 64, the control unit 62 causes an increase of the gap E, this results in a reduction of the weight per unit area of the web taken by the doffer 13 without it being necessary to vary the speed of rotation of the doffer 13, the condenser 17, 18 and of the detacher 19, and therefore without variation of the speed at which the corresponding elementary web is produced. It is therefore unnecessary to adjust the speed of input into the crosslapper when the adjustment in the weight per unit area of the elementary web is produced solely by a variation of the spacing E. An adjustment of the weight per unit area obtained by variation of the speed of rotation of the drum 4 or of any other fibre transfer device, such as the feeder 7, located upstream of the doffer or doffers such as 13, has the same advantage.

In practice, the adjustment of the weight per unit area by variation of the spacing of the doffer or doffers with respect to the carding drum is very advantageous because it does not impose any variation of speeds, neither upstream nor downstream. In a carding machine with at least two doffers, elementary webs having different weights per unit area and varying in a different or offset manner in time with respect to one another can be produced and delivered to the superimposition station at a constant speed which is the same for the at least two elementary webs, this speed also being that of the input section 23, in principle. It is possible to obtain a similar result by combining a variation of the speed of the drum 4 or of a device located upstream and a variation of the separation E of one of the doffers with respect to the drum 4 in order to modify the weight of one of the elementary webs with respect to the variable weight of the other web.

There will now be described, with reference to FIG. 4, how, according to the invention, it is possible to vary the speed of the input section 23 of the front belt 24 without interfering with the rest of the operation of the crosslapper, and in particular without inducing modification of the speed at which the lapper carriage feeds the web onto the output belt 26.

In this figure, all of the speeds are shown with arrows corresponding to the direction considered as positive, which is the direction towards the right (the routing direction taken by the input section 23) for horizontal speeds and the downward direction for vertical speeds.

The belts 24 and 41 have, in the zone located between the carriages 27 and 29, a speed $V_2$, given by the following expression:

$$V_2=V_3-W$$

Given that the stretching factor k (if k=1, there is neither stretching nor compression) due to a difference between $|V_3|$ and $|W|$, the following expression applies:

$$V_3=|W|/k$$

Given:

$$V_2=|W|/k-W \quad \text{(R1)}$$

It is furthermore seen that, if $V_1$ is the speed of circulation of the section 23 and U is the speed of displacement of the accumulator carriage 29:

$$V_2=V_1+2U$$

given:

$$U=(V_1+V_2)/2$$

and consequently, taking account of the expression (R1):

$$U=(V_1+|W|/k-W)/2 \quad \text{(R2)}$$

The application of these calculations gives the following results in practice:

As a function of the speed at which the elementary web is produced, the central processing unit 61 sends an instruction to the motor 57 to correspondingly adjust the speed of the motor 31 in order to give the adapted value to the input speed $V_1$ of the front belt 24. Furthermore, the lapper carriage 27 can for example follow a predetermined periodic speed law, according to which the value of the speed of displacement W of the lapper carriage 27 is determined for each point in the reciprocating travel.

Consequently, the drive motor 52 of the lapper carriage 27 is controlled in order to generate the desired speed law for the speed of displacement W of the lapper carriage 27 as a function of its position along its reciprocating travel. $V_1$ and W being fixed at each instant as just stated, the expression (R2) gives the value "U", the stretching factor "k" also being programmed or in any case known from the construction of the crosslapper for each point in the travel of the lapper carriage 27. There is therefore controlled, from the central processing unit 61, the drive motor 52 of the accumulator carriage 29 in order to give it the speed U determined as has just been described according to the expression (R2). The drive motor 58 of the rear belt 41 is controlled such that the speed $V_4$ of circulation of the rear belt 41 in the zone adjacent to the entry into the accumulator carriage 29 is such that $V_4=V_2=2U-V_1$. It will easily be verified that each zone of the rear belt 41 has the same speed as each zone of the front belt 24 facing it in the path contained between the accumulator carriage 29 and the lapper carriage 27.

The mathematical laws which have been given above are only an example to show the feasibility of the method according to the invention. In detail, these laws can vary according to the kinematics of the crosslapper used. There are many types of crosslappers marketed or known in the literature.

It will be understood that the calculations described above will give the same results each time that the lapper carriage passes through a given point, whatever it may be. It is not therefore necessary for the control unit 61 to repeat the calculations each time. It will suffice for it to do them once at the beginning of a given production and then it can store them in memory in the form of a table giving all the speeds or angular positions to be achieved for each position of the lapper carriage 27.

The method which has just been described is applicable even if the speed law "W" of the lapper carriage 27 as a function of its position along its reciprocating travel is not a constant law fixed once and for all in the control unit 61 but, on the contrary, a law which the control unit 61 is capable of modifying for example in order to optimize the distribution of speeds and accelerations as a function of various parameters such as the width of the fleece to be produced, the average working speed of the crosslapper, the spatial law of distribution of stretchings if any, etc . . .

In the implementation of the method according to the invention, it is also arranged such that:

$$V_1 \text{ average}=V_3 \text{ average}$$

over each forward and return travel of the lapper carriage. Thus, the quantity of web accumulated in the crosslapper fluctuates only between two limit values and it is therefore possible to arrange things such that the accumulator carriage 29 moves only between two limit positions compatible with the hardware embodiment of the machine.

Instead of driving the sections of belts 24 and 41 moving towards the accumulator carriage 29, each of the motors 57 and 58 can also drive any other guidance roller for the belt with which it is respectively associated.

Figure 4:
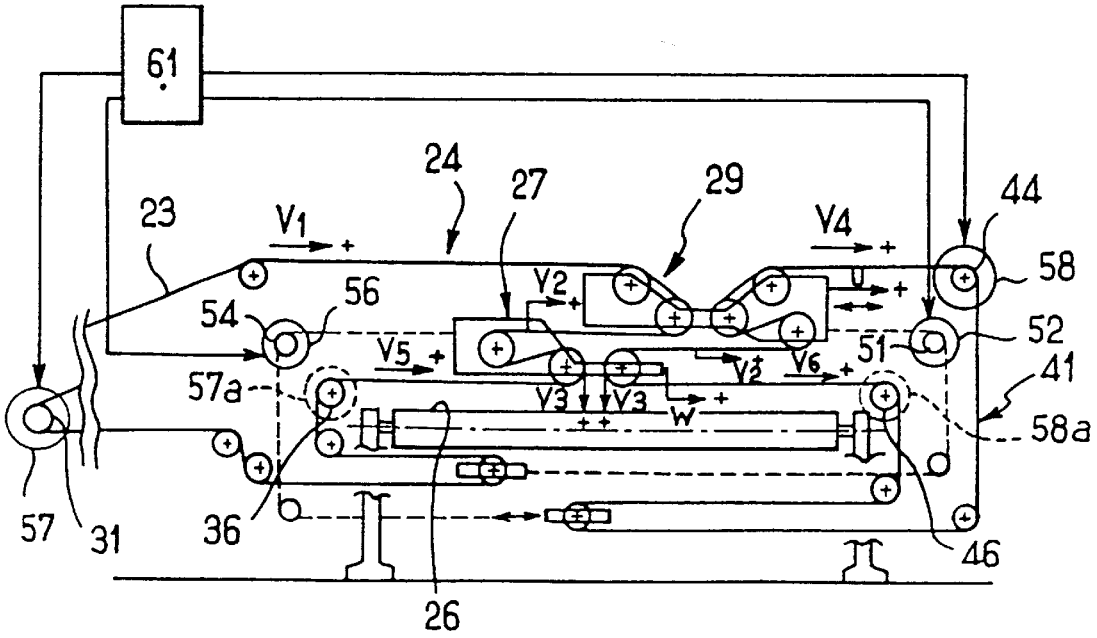
FIG. 4 is an explanatory view of the crosslapper of FIG. 1.

They can, in particular, as shown in dotted line in FIG. 4, be positioned respectively at 57*a* and 58*a* in order to drive fixed rollers 36 and 46 respectively guiding the front belt 24 and the rear belt 41 respectively at the output of the lapper carriage 27. In this case, the operating conditions already described are achieved if the motor 57*a* gives the front belt 24 a speed $V_5$ such that:

$$V_5=W-V_3=W-|W|/k$$

and if the motor 58*a* gives the rear belt 41 a speed $V_6$ such that:

$$V_6=V_3+W=W+|W|/k$$

Certain features of the method according to the invention will now be described in greater detail.

Figure 5:
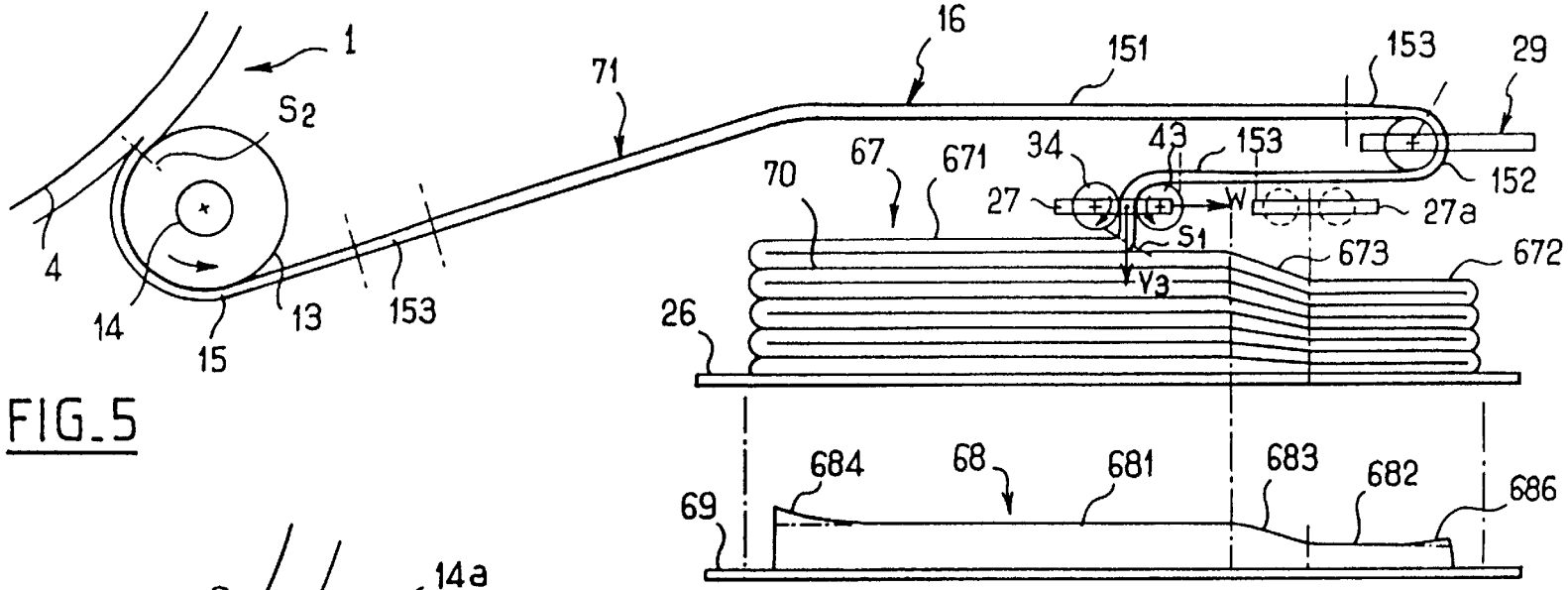
FIGS. 5 and 6 are two explanatory views of certain aspects of the method and of the devices according to the invention.

FIG. 5 shows in a diagrammatic way the production, on the output belt 26 of the crosslapper, which is not fully shown, of a fleece 67 by means of a lappable web 16 whose weight per unit area varies due to an adjustment operated in the carding machine 1 which is also only partially shown.

In this example, for purposes of simplification, the case is described in which the lappable web 16 is obtained from a single elementary web 15 whose weight per unit area is adjusted by variation of the speed of rotation of the doffer 13.

Furthermore, it will initially be assumed that, between the doffer 13 and the lapper carriage 27 of the crosslapper there are no elements such as a condenser or other element varying the weight per unit area and/or the speed of circulation of the web 15, 16. It is furthermore assumed that the speed $V_3$ at which the web 16 is fed through the lapper carriage 27 is permanently equal to the absolute value of the translation speed W of the lapper carriage, such that no stretching or compression occurs at the time of depositing on the output belt 26.

The fleece 67 is generally destined to be consolidated in a consolidation machine such as, for example, a needling machine which must produce a continuous textile product 68 on an output belt 69 of the consolidation machine or another appropriate support. For purposes of illustration, the thickness of the product 68 has been greatly exaggerated with respect to the width shown. It is furthermore shown that the consolidated product is a little narrower than the fleece 67 as the result of a certain contraction which, in a known manner, is generated by the needling process.

In this example, the invention aims to manufacture a textile product having a relatively thick zone 681 over a part of its width starting from one edge, a thinner zone 682 over another part of its width starting from the other edge and a transition zone 683 between these two zones. Such a textile product can be useful for certain applications, in particular for floor carpets used in motor cars, the thinner and therefore weaker part 682 serving to line the zones less exposed to wear, such as for example the vertical section rising towards the door threshold.

According to the invention, the speed of the doffer 13 is adjusted such that each cross-section of web takes, at the place where it undergoes the adjustment of weight per unit area, a weight per unit area value corresponding to that which will be desired taking account of the position at which the lapper carriage 27 will be along its reciprocating travel when this same cross-section will in its turn be deposited by the lapper carriage.

In order to do this, account is taken of the accumulated length of web that there is between the cross-section $S_1$ in the process of being deposited on the output belt 26 (or more precisely on the previously deposited web segment 71 of the fleece 67), and the cross-section $S_2$ whose weight per unit area is in the process of being determined by the speed of the doffer 13 at the time in question. As the web 15, 16 is in this example transported and deposited without compression or extension of any kind along the path which the cross-section $S_2$ will travel until it is deposited on the already constituted fleece, this web length is equal to the total length of a certain number, generally non-integer, of travels of the lapper carriage 27. It is thus possible to know that the lapper carriage 27 will have, when the cross-section $S_2$ is in the process of being deposited, a position that can be predicted, for example position 27*a* in the situation shown in FIG. 5. This position 27*a* is shown in dotted line; it corresponds to a predetermined weight per unit area and the speed of the motor 14 is therefore controlled such that this weight per unit area is produced by the doffer 13 in the cross-section $S_2$.

In order to determine the length of web 15, 16 between the sections $S_1$ and $S_2$, the control unit 61 takes account of the respective positions of the carriages 27 and 29. It knows these positions from the angular positions of the motors 52 and 56 which control the position of the carriages 29 and 27 respectively. Because of this data, the control unit 61 is capable of calculating the length of web 15, 16 contained between the cross-sections $S_1$ and $S_2$ even if this length varies. It has been seen that this length could vary in order to allow the input speed $V_1$ and/or the speed $V_3$ to vary.

As shown, a web 15 will be produced having relatively thick longitudinal regions 151 intended to form part of the zone 681 of the finished product and having a length double the width of the corresponding zone 671 of the fleece 67, alternating with thinner zones 152 having a length double the width of the corresponding zone 672 of the fleece 67, separated by transition zones 153 which will be stacked in the zone 673 of the fleece 67.

If, as a variant, the web 15, 16 undergoes, at a point in its path between the cross-sections $S_2$ and $S_1$, a stretching operation (actual stretching or compression) with a stretching factor of $k_2$ as indicated at point 71, the whole of the length contained between cross-section $S_2$ and the point 71 must be taken into account not with its real value but with a corrected value corresponding to the real length multiplied by the factor $k_2$.

For example, if $k_2$=1.1 (actual stretching by +10%), the whole of the length contained between cross-section $S_2$ and the point 71 must be taken into account with an increase of 10%. This method of calculation is particularly involved when condensers intervene downstream of the point where the adjustment of weight per unit area takes place.

Figure 6:
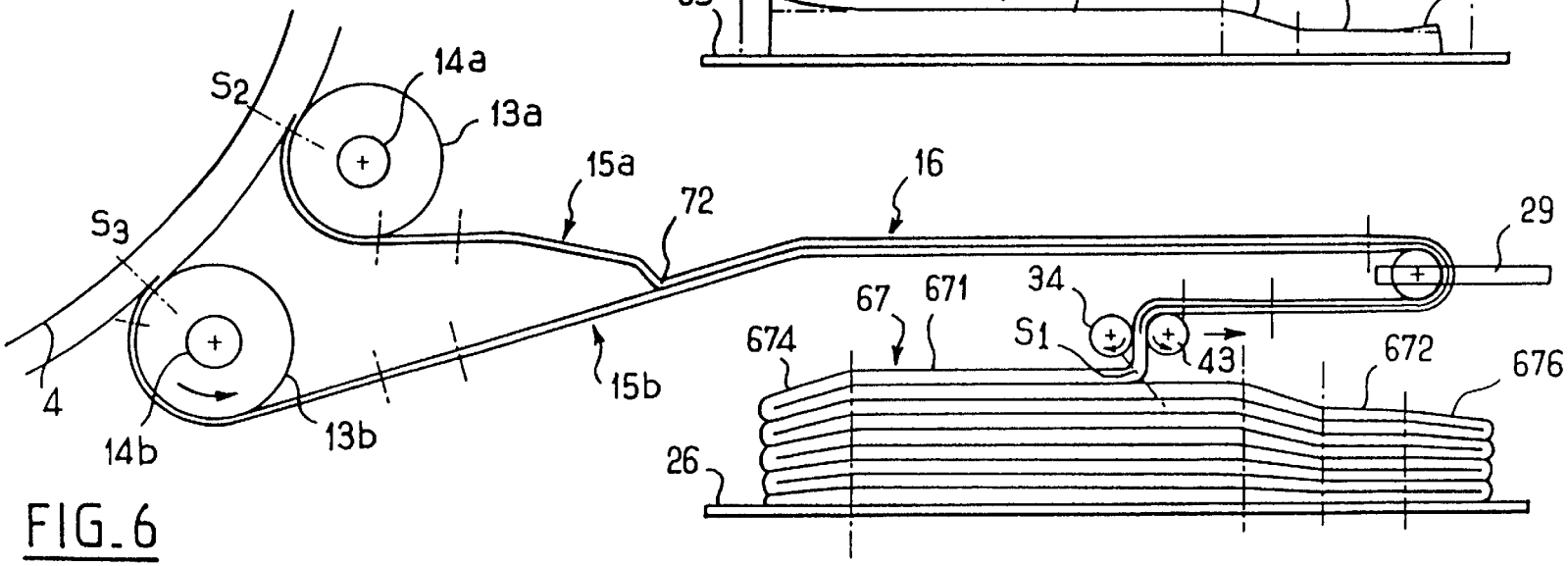

In the example shown in FIG. 6, two mutually independent developments with respect to FIG. 5 are shown.

According to a first development, a method will be explained for adjusting the weight per unit area in a coordinated manner on two elementary webs 15*a* and 15*b* which contribute, both in the same proportions, in each transverse cross-section of the web 16, to the creation of thickness variations desired for the web 16 along its length.

In a first variant of the first development, it is assumed that the weight per unit area of each of the webs 15*a* and 15*b* is modified by variation of the separation between each doffer 13*a* or 13*b* and the drum 4. It is furthermore assumed that the cross-sections $S_2$ of the web 15*a* and $S_3$ of the web 15*b* which undergo the adjustment of weight per unit area are separated by different web lengths from the cross-section $S_1$ which is being deposited. According to the invention, provision is made to calculate these two delay lengths and to control the two adjustment devices, that is to say, in this example, the two doffers 13*a* and 13*b*, in a way that is differentiated such that the variations in thickness produced coincide with one another when the two elementary webs are superimposed at 72 such that the lappable web 16 has the desired weight per unit area at the moment of deposit on the fleece 67 at each point. In the case shown, where it is sought that the two elementary webs 15*a* and 15*b* should vary to produce at each point of the length of the lappable webs a constant respective proportion of the weight per unit area of the lappable web 16, it is understood that the elementary web having the longest path to travel undergoes each thickness modification desired for the lappable web 16 temporally ahead of the other elementary web.

Even if the modifications desired for both of the elementary webs result in each elementary web 15*a* or 15*b* producing a variable proportion of the weight per unit area of the lappable web 16 along the length of the latter, it will be understood that the weight per unit area of the elementary web having the longest path to travel must be adjusted with a longer temporal anticipation than the other elementary web. The difference between the controls applied to the two doffers 13*a* and 13*b* is therefore similar to a time shift, even though this shift may possibly have to vary if the speed at which the web 16 enters the crosslapper varies and/or if the speed at which the web is deposited on the already constituted fleece 67 varies.

In a second variant of the first development, which will be described only where it differs in relation to the first variant, it is assumed that the weight per unit area of each of the elementary webs 15*a* and 15*b* is modified by variation of the speed of rotation of the associated doffer 13*a* or 13*b*. Furthermore, it is arranged that the two elementary webs have, between the cross-section $S_2$ or $S_3$ respectively undergoing the adjustment, and the cross-section $S_1$ in the process of being deposited, substantially the same delay length. This is true at each instant since possible variations due to the movements of the accumulator carriage 29 affect the two delay lengths in the same way. The two elementary webs 15*a* and 15*b* always contribute in the same proportion to the weight per unit area of the lappable web 16. Under these conditions, the motors 14*a* and 14*b* are controlled such that the speed of rotation of the two doffers 13*a* and 13*b* undergo variations which are at each instant in the same proportion with respect to each other, in order that the production speeds of the elementary webs 15*a* and 15*b* are, at each instant, substantially equal to one another. Thus, at the station 72, the two elementary webs 15*a* and 15*b* arrive at the same speed, which varies in time, and it is always possible, in particular by an appropriate control of the displacement of the accumulator carriage 29, to give to the input section 23 of the front belt 24 of the crosslapper, (FIG. 4) a speed corresponding to the input speed of the web 16 at that time. As a function of the configuration of the carding machine, the feature consisting in equalizing the two delay lengths as much as possible can be achieved by adjusting, with different types of means, the weight per unit area of each web respectively. It is possible, for example, to adjust the speed of the doffer for one of the elementary webs, and the speed of rotation of a condenser for the other elementary web.

The other development, also illustrated in FIG. 6, but independent of the use of two elementary webs 15*a* and 15*b*, relates to the production of thinned edge zones 674 and 676, for example to pre-compensate for a conventional fault of excess thickness in the edge zones 684 and 686 produced by the needling. With the thinned edge zones 674 and 676 of FIG. 6, these excess thicknesses are eliminated and the profile of the edge zones of the needled product assumes the shape shown in dotted and dashed line in FIG. 5.

In order to achieve such edge zones, it is possible, for example, by means of an appropriate control of the motor 14*a* and/or 14*b* to correspondingly modify the longitudinal profile of at least one of the elementary webs 15*a* and 15*b*. It is also possible to create, in these zones, a reduction of the web feed speed V3 through the lapper carriage 27, with respect to the absolute speed |W| of the lapper carriage, this reduction being of increasing degree up to the reversal of the direction of motion of the lapper carriage 27 and then becoming progressively less until it disappears when the lapper carriage 27 passes the limit separating the edge zone 674 from the thick zone 671 and, respectively, the limit between the edge zone 676 and the relatively thin zone 672.

When the web is thus deposited on the already constituted fleece 67, with a stretching factor which is different from 1, over at least a portion of the travel of the lapper carriage, one of the possible methods of calculation for determining the thickness adjustments to be given to the cross-sections S2 and S3 consists in reasoning in imaginary travels of the lapper carriage 27. An imaginary travel is that which the lapper carriage would have carried out if it had moved at each instant with a speed whose absolute value |W| would have been equal to the web feed speed $V_3$ at the point in question. Furthermore, there is created, in the central processing unit 61, a correspondence table between each point of the imaginary travel, each point of the real travel and the weight per unit area desired for the lappable web, before stretching, at each of these points. The delay length is calculated for the cross-sections S2 and S3 respectively undergoing the adjustment, these delay lengths are converted into a number of imaginary travels, and the decimal portion of this number is interpreted in order to know the imaginary position or positions which the lapper carriage will have when it deposits the cross-sections $S_2$ and $S_3$. There is then derived the weight per unit area to be given to each of the cross-sections $S_2$ and $S_3$ according to the correspondence table.

The invention is not of course limited to the described and shown examples. It is possible, in many different ways, to combine various methods of adjustment of weight per unit area which have been described by way of example.

The invention can be used for producing, with the help of the adjustment means provided in the carding machine, a fleece profile which is simply intended to pre-compensate for the excess thickness defects at the edges introduced in the needling machine or other consolidation machine, or in certain types of crosslapper having a less sophisticated design than those capable of controlling the web feed speed at all points in the travel of the lapper carriage.

It can be advantageous, in the case of a carding machine producing at least two elementary webs such as 15*a* and 15*b*, to produce different longitudinal profiles for these two webs. For example, in the example of FIG. 6, the adjustment carried out on the web 15*b* could be used for producing the two zones 671 and 672 of different thickness as well as the transition zone 673 and the web 16*a* could undergo the adjustments producing the thinned edges 674 and 676.

Since it is preferable, according to the invention, to control the whole of the process according to the real or imaginary position of the lapper carriage at each instant, and according to the position correlatively taken by the accumulator carriage 29, it is also preferable that the control unit 61 of the crosslapper should have a master function in the implementation of the method. This control unit 61 sends to the web production machine and in particular to its control unit 62 instructions that the control unit 62 converts into commands applied to the motor or motors affecting the adjustment of the weight per unit area of the elementary web or webs. But it could also be considered that the programming should be carried out on the control unit 62 of the web production machine, which could then, at each instant, call up from the control unit 61 of the crosslapper the data which it would need in order to determine the controls to be applied at each instant, and in particular the data relating to the position of the two carriages 27, 29.

It could also be considered that the two control units 61, 62 are grouped as a single control unit, the web production machine and the crosslapper then forming (conceptually) a single machine.

In certain installations, in particular when the web production machine is pre-existent, the control unit 62 will be able to assume, at least partly, the form of an added intermediate module, capable of taking into account and injecting into the control circuit of the production machine variable instructions for the motors carrying out the adjustment of weight per unit area. Alternatively, the control unit 61 could comprise outputs capable of being connected directly to the web production machine.

The invention makes it possible to produce any type of profiling, particularly with more than two zones of different thicknesses over the width of the fleece, or with a thickness profile which varies all along at least one zone or the totality of the width of the fleece, in order to produce a profile which can be concave, convex or alternately concave and convex.

The invention is not limited to assemblies in which possible variations in production speed of the web are compensated for by variation of an accumulation in the crosslapper. It is also possible to vary the working speed of the whole of the crosslapper, and for example to create a variable accumulation downstream of the crosslapper or to vary in a corresponding manner the speed of the following machines, such as a needling machine.

What is claimed is:

1. A method of producing a textile fleece comprising the steps of:

in a carding machine, producing at least one elementary web while providing said elementary web with a weight per unit area which varies along a longitudinal direction of said elementary web;

feeding said elementary web into a crosslapper;

in said crosslapper, forming a fleece by folding a lappable web incorporating said elementary web alternately in one direction and in the other on a transverse output belt of said crosslapper, whereby said variable weight per unit area of the elementary web results in a substantially predetermined distribution of weight per unit area over the width of said fleece;

wherein said step of providing the elementary web with a variable weight per unit area comprises the step of performing, in the carding machine, adjustment of at least one operating parameter which is independent of a speed of rotation of a doffer collecting fibers for the elementary web from at least one carding drum of the carding machine.

2. The method according to claim 1, wherein said step of performing adjustment comprises performing an adjustment in a zone located downstream of said drum of the carding machine, with respect to the direction of transit of the fibers in the carding machine.

3. The method according to claim 1, wherein said step of performing adjustment comprises modifying, as said operating parameter, a separation between said drum and said doffer.

4. The method according to claim 1, wherein said step of performing adjustment affects a speed of transit of the fibers in said carding machine upstream of said doffer.

5. The method according to claim 1, wherein said step of performing adjustment comprises adjusting as said operating parameter, the speed of rotation of said at least one drum.

6. The method according to claim 1, comprising the step of varying the length of a web accumulation path between the carding machine and a lapper carriage of said crosslapper according to a difference between a variable web outlet speed at which the carding machine delivers the elementary web, and a speed at which the lapper carriage deposits the web on said output belt.

7. The method according to claim 6, wherein said step of varying the length is performed inside the crosslapper thereby to cause a speed of web intake into the crosslapper to equal said variable web outlet speed of the carding machine.

8. The method according to claim 1, wherein said step of performing adjustment comprises adjusting, as said operating parameter, a relative speed of at least one condensing device placed downstream of the doffer, with respect to the speed of said doffer.

9. The method according to claim 1, wherein said step of adjusting comprises adjusting, as said operating parameter, a relative speed of a detacher delivering the elementary web at an outlet of the carding machine, with respect to the speed of said doffer.

10. The method according to claim 1, wherein said step of performing adjustment comprises adjusting, as said operating parameter, a relative speed of a detacher delivering the elementary web at an outlet of the carding machine, with respect to a transit speed of the fibers defined by a condensing device receiving fibers collected by said doffer.

11. The method according to claim 1, comprising the steps of determining a length of web contained between a first web cross-section in the process of being deposited on the output belt in the crosslapper, and a second web cross-section located at the point in the path of the fibers where said step of performing adjustment influences the weight per unit area of the elementary web;

determining on the basis of said length the point in the width of the fleece where the second cross-section will be deposited; and performing said adjustment of the operating parameter according to a weight per unit area programmed for said point in the width of the fleece.

12. The method according to claim 11, comprising the step of taking into account said length as corrected by at least one stretching factor of a stretch applied to the web downstream of said point in the path of the fibers.

13. The method according to claim 11, comprising the step of programming, at least by zones, the distribution of weight per unit area desired for the lappable web arriving in said lapper carriage at each point in the travel of the lapper carriage, and issuing at each instant as a function of said distribution, control signals for said adjusting of at least one operating parameter.

14. The method according to claim 1, comprising the step of producing said lappable web by superimposing at least two elementary webs, and wherein said step of adjusting at least one operating parameter is performed differently for each of said elementary webs.

15. The method according to claim 14, wherein for one of the elementary webs, said operating parameter is adjusted according to a similar longitudinal profile as a longitudinal profile for the other of said elementary webs, except for a longitudinal shift between said longitudinal profiles at the respective points of the length of the elementary webs where said adjustment influences the weight per unit area of each elementary web.

16. The method according to claim 14, wherein one of the operating parameters is left constant for one of the elementary webs.

17. The method according to claim 14, wherein said operating parameter is independent of the speed of production of the elementary webs by the carding machine.

18. The method according to claim 14, in which said operating parameter affects the speed of production of the elementary webs, wherein said adjustment is performed such that the production speeds of the elementary webs are equal to each other at each instant, said method comprising managing at each instant equal lengths between a first web cross-section in the process of being deposited on the output belt in the crosslapper and each second web cross-section located where said adjustment influences the weight per unit area of a respective elementary web.

19. The method according to claim 1, comprising predetermining the distribution of weight per unit area over the width of the fleece such that a consolidated textile product obtained at the output of at least one consolidation machine placed downstream of the crosslapper has a distribution of weight per unit area varying at least by zones over the width of the consolidated textile product.

20. A method of producing a textile fleece comprising the steps of:

in a carding machine, producing at least one elementary web while providing said elementary web with a weight per unit area which varies along a longitudinal direction of said elementary web;

feeding said elementary web into a crosslapper;

in said crosslapper, forming a fleece by folding a lappable web, incorporating said elementary web, alternately in one direction and in the other on a transverse output belt of said crosslapper, whereby said variable weight per unit area of the elementary web results in a substantially predetermined distribution of weight per unit area over the width of said fleece;

wherein said step of providing the elementary web with a variable weight per unit area comprises the step of performing in the carding machine adjustment of at least one operating parameter which is independent of a speed of production of the elementary web by the carding machine.

21. The method according to claim 20, wherein said step of performing adjustment comprises modifying, as said operating parameter, a separation between said drum and said doffer.

22. The method according to claim 20, wherein said step of performing adjustment affects a speed of transit of the fibers in said carding machine upstream of said doffer.

23. The method according to claim 20, wherein said step of performing adjustment comprises adjusting as said operating parameter, the speed of rotation of at least one drum of the carding machine.

24. The method according to claim 20, comprising the steps of determining a length of web contained between a first web cross-section in the process of being deposited on the output belt in the crosslapper, and a second web cross-section located at the point in the path of the fibers where said step of performing adjustment influences the weight per unit area of the elementary web;

determining on the basis of said length the point in the width of the fleece where the second cross-section will be deposited; and performing said adjustment of the operating parameter according to a weight per unit area programmed for said point in the width of the fleece.

25. The method according to claim 20, comprising the step of taking into account said length as corrected by at least one stretching factor of a stretch applied to the web downstream of said point in the path of the fibers.

26. The method according to claim 20, comprising the step of programming, at least by zones, the distribution of weight per unit area desired for the lappable web arriving in said lapper carriage at each point in the travel of the lapper carriage, and issuing at each instant as a function of said distribution, control signals for said adjusting at least one operating parameter.

27. The method according to claim 20, comprising the step of producing said lappable web by superimposing at least two elementary webs, and wherein said step of adjusting at least one operating parameter is performed differently for each of said elementary webs.

28. The method according to claim 20, wherein for one of the elementary webs, said operating parameter is adjusted according to a similar longitudinal profile as a longitudinal profile for the other of said elementary webs, except for a longitudinal shift between said longitudinal profiles at the respective points of the length of the elementary webs where said adjustment influences the weight per unit area of each elementary web.

29. The method according to claim 20, comprising predetermining the distribution of weight per unit area over the width of the fleece such that a consolidated textile product obtained at the output of at least one consolidation machine placed downstream of the crosslapper has a distribution of weight per unit area varying at least by zones over the width of the consolidated textile product.

30. A method of producing a textile fleece comprising the steps of:

in a carding machine, producing at least one elementary web while providing said elementary web with a weight per unit area which varies along a longitudinal direction of said elementary web;

feeding said elementary web into a crosslapper;

in said crosslapper, forming a fleece by folding a lappable web incorporating said elementary web alternately in one direction and in the other on a transverse output belt of said crosslapper, whereby said variable weight per unit area of the elementary web results in a substantially predetermined distribution of weight per unit area over the width of said fleece;

varying the length of a web accumulation path between the carding machine and a lapper carriage of said crosslapper according to a difference between a speed at which the carding machine delivers the elementary web and a speed at which the lapper carriage deposits the lappable web on said output belt;

determining a length of web contained between a first web cross-section in the process of being deposited on the output belt in the crosslapper and a second web cross-section located at the point in the path of the fibers where said step of performing adjustment influences the weight per unit area of the elementary web;

determining on the basis of said length the point in the width of the fleece where the second cross-section will be deposited; and performing said adjustment of the operating parameter according to a weight per unit area programmed for said point in the width of the fleece.

31. The method according to claim 30, comprising the step of controlling said length of said web-accumulation path thereby to equalize at each instant a variable web delivery speed through a lapper carriage of the crosslapper with a traveling speed of the lapper carriage over the width of said output belt.

32. The method according to claim 30, comprising the steps of:

controlling said length of said web-accumulation path thereby to adjust at each instant a web delivery speed through a lapper carriage of the crosslapper with respect to a traveling speed of the lapper carriage over the width of said output belt.

33. The method according to claim 30, comprising the step of taking into account said length as corrected by at least one stretching factor of a stretch applied to the web downstream of said point in the path of the fibers.

34. The method according to claim 30, wherein said step of providing said elementary web with a variable weight per unit area induces variation in the instantaneous speed of production of the elementary web by the carding machine and said step of varying is controlled for accommodating said variations in the instantaneous speed.

35. The method of producing a textile fleece comprising the steps of:

in a carding machine, producing at least one elementary web while providing said elementary web with a weight per unit area which varies along a longitudinal direction of said elementary web;

feeding said elementary web into a crosslapper;

in said crosslapper, forming a fleece by folding a lappable web incorporating said elementary web alternately in one direction and in the other on a transverse output belt of said crosslapper, whereby said variable weight per unit area of the elementary web results in a substantially predetermined distribution of weight per unit area over the width of said fleece;

said step of providing the elementary web with a variable weight per unit area comprises the step of performing in the carding machine adjustment of at least one operating parameter which affects a web outlet speed of the carding machine; and the method comprises the step of varying the length of a web accumulation path between the carding machine and a lapper carriage of said crosslapper according to a difference between a variable web outlet speed at which the carding machine delivers the elementary web and a speed at which the lapper carriage deposits the web on said output belt.

36. The method according to claim 35, wherein said step of performing adjustment comprises adjusting, as said operating parameter, a relative speed of a detacher delivering the elementary web at an outlet of the carding machine, with respect to a transit speed of the fibers defined by a condensing device receiving fibers collected by a doffer.

37. The method of producing a textile fleece according to claim 35, wherein said operating parameter is selected from a rotating speed of a doffer collecting fibers on a carding drum of the carding machine, and a rotating speed of a fiber-handling element mounted in the carding machine downstream of the doffer.

38. The method according to claim 35, comprising the steps of determining a length of web contained between a first web cross-section in the process of being deposited on the output belt in the crosslapper, and a second web cross-section located at the point in the path of the fibers where said step of performing adjustment influences the weight per unit area of the elementary web;

determining on the basis of said length the point in the width of the fleece where the second cross-section will be deposited; and performing said adjustment of the operating parameter according to a weight per unit area programmed for said point in the width of the fleece.

39. The method according to claim 38, comprising the step of taking into account said length as corrected by at least one stretching factor of a stretch applied to the web downstream of said point in the path of the fibers.

40. The method according to claim 35, comprising the step of producing said lappable web by superimposing at least two elementary webs, and wherein said step of adjusting at least one operating parameter is performed differently for each of said elementary webs; further comprising said operating parameter affects the speed of production of the elementary webs, wherein said adjustment is performed such that the production speeds of the elementary webs are equal to each other at each instant, said method comprising managing at each instant equal lengths between a first web cross-section in the process of being deposited on the output belt in the crosslapper and each second web cross-section located where said adjustment influences the weight per unit area of a respective elementary web.

41. The method according to claim 40, wherein for one of the elementary webs, said operating parameter is adjusted according to a similar longitudinal profile as a longitudinal profile for the other of said elementary webs, except for a longitudinal shift between said longitudinal profiles at the respective points of the length of the elementary webs where said adjustment influences the weight per unit area of each elementary web.

42. The method according to claim 35, comprising predetermining the distribution of weight per unit area over the width of the fleece such that a consolidated textile product obtained at the output of at least one consolidation machine placed downstream of the crosslapper has a distribution of weight per unit area varying at least by zones over the width of the consolidated textile product.

43. A method of producing a textile fleece comprising the steps of:

in a carding machine having at least one operating parameter, producing at least one elementary web while providing said elementary web with a weight per unit area which varies along a longitudinal direction of said elementary web;

feeding said elementary web into a crosslapper;

in said crosslapper, forming a fleece by folding a lappable web incorporating said elementary web alternately in one direction and in the other on a transverse output belt of said crosslapper, whereby said variable weight per unit area of the elementary web results in a substantially predetermined distribution of weight per unit area over the width of said fleece;

comprising the step of programming, at least by zones, the distribution of weight per unit area desired for the lappable web arriving in said lapper carriage at each point in the travel of the lapper carriage; and issuing at each instant as a function of said distribution, control signals for adjusting said at least one operating parameter.

44. The method according to claim 43, wherein for one of the elementary webs, said operating parameter is adjusted according to a similar longitudinal profile as a longitudinal profile for the other of said elementary webs, except for a longitudinal shift between said longitudinal profiles at the respective points of the length of the elementary webs where said adjustment influences the weight per unit area of each elementary web.

45. The method according to claim 43, wherein one of the operating parameters is left constant for one of the elementary webs.

46. The method according to claim 43, wherein said operating parameter is independent of the speed of production of the elementary webs by the carding machine.

47. The method according to claim 43, in which said operating parameter affects the speed of production of the elementary webs, wherein said adjustment is performed such that the production speeds of the elementary webs are equal to each other at each instant, said method comprising managing at each instant equal lengths between a first web cross-section in the process of being deposited on the output belt in the crosslapper and each second web cross-section located where said adjustment influences the weight per unit area of a respective elementary web.

48. The method according to claim 43, comprising predetermining the distribution of weight per unit area over the width of the fleece such that a consolidated textile product obtained at the output of at least one consolidation machine placed downstream of the crosslapper has a distribution of weight per unit area varying at least by zones over the width of the consolidated textile product.

49. A fleece production device comprising:

a carding machine configured for producing at least one elementary web and provided with at least one web-weight adjustment means;

control means for controlling variations of the web-weight adjustment means during operation;

a crosslapper mounted downstream of the carding machine and comprising a web inlet means, an output belt movable in a direction transverse to the web-inlet means, and means for laying a lappable web, incorporating said at least one elementary web, alternately in a transverse direction and in an opposed transverse direction on the output belt;

wherein said web-weight adjustment means is selected from:

a means for adjusting a separation between a doffer and a drum of the carding machine;

a means for adjustment of the speed of rotation of the doffer of a condenser with respect to the speed of rotation of the carding machine;

a means for adjustment of the speed of rotation of a detacher with respect to the speed of rotation of a fiber transfer device located immediately upstream; and a means for adjustment of the speed of a fiber transfer device located upstream of the doffer.

50. The device according to claim 49, wherein the carding machine comprises at least two web production paths for producing two elementary webs, means being provided for forming said lappable web by superimposition of said elementary webs.

51. The device according to claim 50, wherein said web-weight adjustment means comprises at least two elementary web-weight adjustment means, at least one of said elementary web-weight adjustment means being provided for each web production path, respectively, and wherein the control means are capable of controlling different and coordinate adjustments for said two elementary web-weight adjustment means.

52. The device according to claim 51, wherein said elementary web-weight adjustment means are configured for modifying a different operating parameter for each of the two paths, respectively.

53. The device according to claim 50, wherein the adjustment means of one of the paths is a means for adjusting, in operation, a rotating speed of a doffer with respect to the speed of rotation of a carding drum on which said doffer is adapted to collect fibers.

54. The device according to claim 50, wherein the control means are capable of adjusting the web weight adjustment means of one of the web production paths at a constant web weight value while variably adjusting the web weight adjustment means of the other web production path.

55. The device according to claim 50, comprising, for each elementary web production path, a means for adjustment affecting the speed of production of each elementary web, in that a length of web contained between a cross-section in the process of being deposited on the output belt and each cross section undergoing the adjustment of weight per unit area is the same for all of the elementary webs, and wherein the control means actuates, at least indirectly, the two adjustment means such that the speed of production of the elementary webs are equal to each other at each instant.

56. A fleece device comprising:

a carding machine adapted to produce at least two elementary webs along two respective web-production paths and web-weight adjustment means for adjusting the weight per unit area of a corresponding one of the elementary webs;

control means for controlling variations of the web-weight adjustment means during operation; and a crosslapper mounted downstream of the carding machine and comprising a web inlet means, an output belt movable in a direction transverse to the web inlet means, and means for laying a lappable web, incorporating said two elementary webs in superimposed relationship, alternately in a transverse direction and in an opposed transverse direction on the output belt.

57. The device according to claim 56, wherein said web-weight adjustment means comprises at least two elementary web-weight adjustment means, at least one of said elementary web-weight adjustment means being provided for each web production path, respectively, and wherein the control means are capable of controlling distinct and coordinated adjustment values for said two elementary web-weight adjustment means.

58. The device according to claim 56, wherein said elementary web-weight adjustment means are configured for modifying a different operating parameter for each of the two paths, respectively.

59. The device according to claim 56, wherein the adjustment means of one of the paths is a means for adjusting, in operation, a rotating speed of a doffer with respect to the speed of rotation of a carding drum on which said doffer is adapted to collect fibers.

60. The device according to claim 56, wherein the control means are capable of adjusting the web weight adjustment means of one of the web production paths at a constant web weight value while variably adjusting the web weight adjustment means of the other web production path.

61. The device according to claim 56, comprising, for each elementary web production path, a means for adjustment affecting the speed of production of each elementary web, in that a length of web contained between a cross-section in the process of being deposited on the output belt and each cross section undergoing the adjustment of weight per unit area is the same for all of the elementary webs, and wherein the control means actuates, at least indirectly, the two adjustment means such that the speed of production of the elementary webs are equal to each other at each instant.

62. A fleece production device comprising:

a carding machine configured for producing at least one elementary web and provided with at least one web-weight adjustment means for adjustment of the weight per unit area of said at least one elementary web;

a control means for controlling variations of the web-weight adjustment means during operation;

a crosslapper mounted downstream of the carding machine and comprising:

a) a web inlet means;

b) an output belt movable in a direction transverse to the web inlet means; and c) a lapper means for laying a lappable web, incorporating said at least one elementary web, alternately in a transverse direction and in opposed transverse direction on the output belt; and wherein said fleece production device includes web guiding means, including said web inlet means, and extending between said carding machine and said lapper means and defining a web path having a variable length, and wherein the control means comprises means for taking into account the length of web between a first web cross-section in the process of being deposited on the output belt of the crosslapper and a second web cross-section undergoing the adjustment, and a total distance which the lapper carriage will have to travel in order to deposit this length and for determining therefrom the point in the width of the fleece where the second web cross-section will be deposited, and in order to form the said control signal as a function of a weight per unit area programmed for the lappable web at the point in the width of the fleece where said second web cross-section will be deposited.

63. The fleece production device according to claim 62, wherein a means for varying the length of said web path is included in said crosslapper.

64. The fleece production device according to claim 63, wherein a partial length of said web path, extending between said second web cross section and said web-inlet means of the crosslapper is substantially constant.

65. The device according to claim 63, wherein said control means is further configured for taking into account a stretching factor to which the web is subjected downstream of the zone of the carding machine in which said adjustment is carried out.

66. The device according to claim 62, wherein said control means is configured for taking into account a succession of stretching factors which the lappable web is subjected to in each position of the lapper means due to a variable difference between a speed of displacement of the lapper means and a speed at which the lapper means feeds the lappable web onto the output belt.

67. The device according to claim 62, wherein during said taking into account of the web length, the control means is configured for taking account of the position of an accumulator carriage provided in the crosslapper, as part of said guiding means, and is configured for varying in time the length of web accumulated between said first and second cross-sections.

68. A fleece production device comprising:

a carding machine configured for producing at least one elementary web and provided with at least one web-weight adjustment means affecting a web outlet speed of said carding machine;

a crosslapper mounted downstream of the carding machine and comprising a web inlet means, an output belt movable in a direction transverse to the web inlet means and a lapper carriage for laying a lappable web, incorporating said at least one elementary web, alternately in a transverse direction and in an opposed transverse direction on the output belt, and a web accumulation means adapted to define a variable length of web accumulated in said crosslapper upstream of said lapper carriage; and control means for jointly controlling the web-weight adjustment means of the carding machine and the web accumulation means of the cross-lapper thereby to vary in operation the weight per unit area of the elementary web and adapt the conveying speed of the web inlet means to a web production speed.

69. The device according to claim 68, wherein said control means are configured for varying the length of web accumulated in the crosslapper as a function of the difference between an instantaneous speed of input of the lappable web into the crosslapper and an instantaneous speed at which the lapper carriage feeds the lappable web onto the output belt.

70. The device according to claim 69, wherein the speed at which the lapper carriage feeds the lappable web onto the output belt is in a variable ratio with the speed of displacement of the lapper carriage.

71. The device according to claim 69, wherein said control means comprises:

means for allowing programming of distribution of weight per unit area over the width of the fleece to be produced;

means for determining at each instant the length of lappable web accumulated in the crosslapper and, respectively, the point in the reciprocating travel of the lapper carriage where a cross-section of elementary web in the process of undergoing effects of the web-weight adjustment means will be deposited;

means for controlling the web-weight adjustment means of the web production device according to the programmed weight per unit area at said point in the width of the fleece; and means for controlling the web-accumulation means as a function of the web-outlet speed which results at the outlet of the web production device, from the control applied to the web-weight adjustment means.

72. A fleece production device comprising:

a carding machine configured for producing at least one elementary web and provided with at least one web-weight adjustment means for adjustment of the weight per unit area of said at least one elementary web;

a control means for controlling variations of the web-weight adjustment means during operation;

a crosslapper mounted downstream of the carding machine and comprising:

a) a web inlet means;

b) an output belt movable in a direction transverse to the web inlet means; and c) a lapper means for laying a lappable web, incorporating said at least one elementary web, alternately in a transverse direction and in opposed transverse direction on the output belt;

wherein said fleece production device includes web guiding means, including said web inlet means, and extending between said carding machine and said lapper means and defining a web path having a variable length, and wherein the control means comprises means for taking into account the length of web between a first web cross-section in the process of being deposited on the output belt of the crosslapper and a second web cross-section undergoing the adjustment, and a total distance which the lapper carriage will have to travel in order to deposit this length and for determining therefrom the point in the width of the fleece where the second web cross-section will be deposited, and in order to form the said control signal as a function of a weight per unit area programmed for the lappable web at the point in the width of the fleece where said second web cross-section will be deposited; and wherein said control means is configured for taking into account a succession of stretching factors which the lappable web is subjected to in each position of the lapper means due to a variable difference between the speed of displacement of the lapper means and the speed at which the lapper means feeds the lappable web onto the output belt.

73. The device according to claim 72, wherein said control means is further configured for taking into account a stretching factor to which the web is subjected downstream of the zone of the carding machine in which said adjustment is carried out.

74. The device according to claim 72, wherein during said taking into account of the web length, the control means is configured for taking account of the position of an accumulator carriage provided in the crosslapper, as part of said guiding means, and is configured for varying in time the length of web accumulated between said first and second cross-sections.

75. A fleece production device comprising:

a carding machine configured for producing at least one elementary web and provided with at least one web-weight adjustment means affecting a web outlet speed of said carding machine;

a crosslapper mounted downstream of the carding machine and comprising a lapper carriage, a web inlet means, an output belt movable in a direction transverse to the web inlet means and a lapper means for laying a lappable web, incorporating said at least one elementary web, alternately in a transverse direction and in an opposed transverse direction on the output belt, and a web accumulation means adapted to define a length of web accumulated in said crosslapper upstream of said lapper means;

control means for jointly controlling the web-weight adjustment means of the carding machine and the web accumulation means of the crosslapper thereby to vary in operation the weight per unit area of the elementary web and adapt the conveying speed of the web inlet means to the web production speed;

wherein said control means are configured for varying the length of web accumulated in the crosslapper as a function of the difference between an instantaneous speed of input of the lappable web into the crosslapper and an instantaneous speed at which the lapper carriage feeds the lappable web onto the output belt; and wherein said speed at which the lapper carriage feeds the lappable web onto the output belt is in a variable ratio with a speed of displacement of the lapper carriage.

76. The device according to claim 75, wherein said control means comprises:

means for allowing programming of distribution of weight per unit area over the width of the fleece to be produced;

means for determining at each instant the length of lappable web accumulated in the crosslapper and, respectively, the point in the reciprocating travel of the lapper carriage where a cross-section of elementary web in the process of undergoing effects of the web-weight adjustment means will be deposited;

means for controlling the web-weight adjustment means of the web production device according to the programmed weight per unit area at said point in the width of the fleece; and means for controlling the web-accumulation means as a function of a web-outlet speed which results at the outlet of the web production device, from the control applied to the web-weight adjustment means.

77. A fleece production device comprising:

a carding machine configured for producing at least one elementary web and provided with at least one web-weight adjustment means;

control means for controlling variations of the web-weight adjustment means during operation;

a crosslapper mounted downstream of the carding machine and comprising a web inlet means, an output belt movable in a direction transverse to the web-inlet means, and means for laying a lappable web, incorporating said at least one elementary web, alternately in a transverse direction and in an opposed transverse direction on the output belt, wherein the carding machine comprises at least two web production paths for producing two elementary webs, means being provided for forming said lappable web by superimposition of said elementary webs, and wherein said web-weight adjustment means is selected from:

a means for adjusting a separation between a doffer and a drum of the carding machine, a means for adjustment of the speed of rotation of the doffer of the carding machine, a means for adjustment of the speed of rotation of a detacher with respect to the speed of rotation of a fiber transfer device located immediately upstream; and a means for adjustment of the speed of a fiber transfer device located upstream of the doffer.

78. The device according to claim 77, wherein said web-weight adjustment means comprises at least two elementary web-weight adjustment means, at least one of said elementary web-weight adjustment means being provided for each web production path, respectively, and wherein the control means are capable of controlling different and coordinate adjustments for said two elementary web-weight adjustment means.

79. The device according to claim 78, wherein said elementary web-weight adjustment means are configured for modifying a different operating parameter for each of the two paths, respectively.

80. The device according to claim 79, wherein the adjustment means of one of the paths is a means for adjusting, in operation, a rotating speed of a doffer with respect to the speed of rotation of a carding drum on which said doffer is adapted to collect fibres.

81. The device according to claim 77, wherein the control means are capable of adjusting the web weight adjustment means of one of the web production paths at a constant web weight value while variably adjusting the web weight adjustment means of the other web production path.

82. The device according to claim 77, comprising, for each elementary web production path, a means for adjustment affecting the speed of production of each elementary web, in that a length of web contained between a cross-section in the process of being deposited on the output belt and each cross-section undergoing the adjustment of weight per unit area is the same for all of the elementary webs, and wherein the control means actuates, at least indirectly, the two adjustment means such that the speed of production of the elementary webs are equal to each other at each instant.

83. A fleece production device comprising:

a carding machine configured for producing at least one elementary web and provided with at least one web-weight adjustment means affecting a web outlet speed of said carding machine;

a crosslapper mounted downstream of the carding machine and comprising a web inlet means, an output belt movable in a direction transverse to the web inlet means and a lapper means for laying a lappable web, incorporating said at least one elementary web, alternately in a transverse direction and in an opposed transverse direction on the output belt, and a web accumulation means adapted to define a length of web accumulated in said crosslapper upstream of said lapper carriage; and control means for jointly controlling the web-weight adjustment means of the carding machine and the web accumulation means of the crosslapper thereby to vary in operation the weight per unit area of the elementary web and adapt the conveying speed of the web inlet means to the web production speed, wherein said control means are configured for varying the length of web accumulated in the crosslapper as a function of the difference between the instantaneous speed of input of the lappable web into the crosslapper and the instantaneous speed at which the lapper carriage feeds the lappable web onto the output belt.

84. The device according to claim 83, wherein the speed at which the lapper carriage feeds the lappable web onto the output belt is in a variable ratio with the speed of displacement of the lapper carriage.

85. The device according to claim 83, wherein said control means comprises:

means for allowing programming of distribution of weight per unit area over the width of the fleece to be produced;

means for determining at each instant the length of lappable web accumulated in the crosslapper and, respectively, the point in the reciprocating travel of the lapper carriage where a cross-section of elementary web in the process of undergoing effects of the web-weight adjustment means will be deposited;

means for controlling the web-weight adjustment means of the web production device according to the programmed weight per unit area at said point in the width of the fleece; and means for controlling the web-accumulation means as a function of the web-outlet speed which results at the outlet of the web production device, from the control applied to the web-weight adjustment means.

* * * * *

UNITED STATES PATENT AND TRADEMARK OFFICE

CERTIFICATE OF CORRECTION

PATENT NO. : 6,195,844 B1
DATED : March 6, 2001
INVENTOR(S) : Jourde et al.

It is certified that error appears in the above-identified patent and that said Letters Patent is hereby corrected as shown below:

Title page,
Item [73], Assignee, please delete "Elbeof" and insert -- Elbeuf --.
Item [57], ABSTRACT, delete the paragraph and insert the following paragraph:

-- A carding machine or other web production device supplies a crosslapper with two elementary webs constituting a lappable web which is deposited in a reciprocating manner on a transverse output belt.

In the device adjustment of the speed of rotation of doffers, of condensers, of detachers, of the drum and/or of the feeder, and/or adjustment of the drum-doffer spacing affect the weight per unit area of the elementary web produced taking account of the weight per unit area desired at each point in the width of the fleece to be formed on the output belt. There is determined the delay length exhibited by each elementary web cross-section undergoing the adjustment of weight with respect to the section of lappable web in the process of being deposited. From this there is derived the position at which each web cross-section will be deposited when it is undergoing the adjustment of thickness and consequently the weight adjustment to be applied to it.

The present invention is useful for producing fleeces of highly varied profiles with great industrial flexibility. --

Column 30,
Line 53, please delete "79" and insert -- 77 --.

Signed and Sealed this

Twenty-fourth Day of September, 2002

*Attest:*

*Attesting Officer*

JAMES E. ROGAN
*Director of the United States Patent and Trademark Office*